United States Patent [19]

Akutsu et al.

[11] 4,206,386

[45] Jun. 3, 1980

[54] GAS DISCHARGE DISPLAY DEVICE

[75] Inventors: Hidezo Akutsu, Kobe; Yoshio Nakagawa, Otsu; Takio Okamoto, Kusatsu; Tamisuke Atsumi, Kobe, all of Japan

[73] Assignee: Matsushita Electric Industrial Co., Ltd., Kadoma City, Japan

[21] Appl. No.: 896,600

[22] Filed: Apr. 14, 1978

[30] Foreign Application Priority Data

| | | | |
|---|---|---|---|
| Apr. 18, 1977 | [JP] | Japan | 52/44889 |
| May 19, 1977 | [JP] | Japan | 52/58262 |
| Nov. 18, 1977 | [JP] | Japan | 52/139335 |

[51] Int. Cl.[2] ..... H05B 37/00; H05B 39/00; H05B 41/00

[52] U.S. Cl. ..... 315/169.4; 340/714

[58] Field of Search ..... 315/169 R, 169 TV; 340/324 M

[56] References Cited

U.S. PATENT DOCUMENTS

| | | | |
|---|---|---|---|
| 3,683,364 | 8/1972 | Holz et al. | 315/169 TV |
| 3,769,543 | 10/1973 | Pennebaker | 315/169 TV |
| 4,005,402 | 1/1977 | Amano | 315/169 TV |

*Primary Examiner*—Alfred E. Smith
*Assistant Examiner*—Robert E. Wise
*Attorney, Agent, or Firm*—Cushman, Darby & Cushman

[57] ABSTRACT

A gas-discharge display device has a parallel array of anodes and a parallel array of cathodes forming a matrix of anode-cathode cross points or discharge dots. The display device is filled with a discharge gas mixture at the discharge dots or cells. Displaying and scanning are respectively achieved through drive circuits supplying discharges of a layer and a smaller current, or discharges for a longer and shorter time respectively.

13 Claims, 29 Drawing Figures

(a)

(b)

(a)

(b)

(A)

(B)

GAS DISCHARGE DISPLAY DEVICE

BACKGROUND OF THE INVENTION

1. Field of Technology

The present invention relates to an improvement in a gas-discharge display device with matrix display panel.

2. Prior Arts

A gas discharge display device with a matrix display panel has been previously disclosed by Skellet, with a construction such as shown in FIG. 1. In FIG. 1, a parallel array of cathodes $K_R$, $K_1$,—, $K_n$ and a parallel array of anodes $A_1$,—, $A_m$ are disposed in a space defined between two parallel glass plates. The parallel array of cathodes and anodes are spaced from each other and are disposed at right angles with respect to each other. A discharging gas mixture mainly consisting of neon is confined in the space between the glass plates, and D.C. voltages are applied between selected one(s) of the cathodes and selected one(s) of the anodes.

Such a type of device is very simple in construction, and therefore has advantages from the view point of manufacture. However, when many discharge dots, which are defined by the crossing portions of anodes and cathodes, are intended to be simultaneously lit, then there is a possibility of cross-talk. That is, there is a possibility of undesirable lighting at cross points other than those intended to be lit. Because of the cross-talk, this simply structured device has not entered into wide practical use.

Thereafter, two different types of improved gas-discharge devices have been disclosed, and have come into practical use. One of them is known as an A.C. type or Illinois type device and is shown in FIG. 2. In this construction both the X-electrodes array 3 and Y-electrodes array 4 are covered with a dielectric material layer 5 and the lighting of dots or cross points is achieved by impressing A.C. voltages between them.

The other different type is known as a D.C. discharge type or Burroughs Corporation type and is shown in FIG. 3. In this construction a pair of a scanning anode A' and a displaying anode A are utilized. In the improved devices shown in FIG. 2 and FIG. 3, cross-talk can be prevented, thereby assuring a stable display. However, these devices have a more complicated structure than the device of FIG. 1, and accordingly are difficult and expensive to manufacture and require a more complicated driving circuit. Specifically, for the A.C. type device of FIG. 2, the driving circuit must contain a discharge sustaining circuit in addition to an address circuit. For the D.C. type device of FIG. 3, a scanning circuit is required in addition to the displaying circuit.

SUMMARY OF THE INVENTION

The present invention provides a novel gas-discharge display device which has less cross-talk and a clear display and has as simple construction as the original Skellet type device. Furthermore, the present device is stably operated with a more simple driving circuit than those required for the devices of FIG. 2 and FIG. 3.

BRIEF EXPLANATION OF THE DRAWING

FIG. 7(*b*) is a sectional side view of a part of the device of FIG. 7(*a*).

FIG. 8(*b*) is a sectional view of a part of modification of the example of a FIG. 8(*a*).

FIG. 22(*b*) is a sectional side view of still another modification of the example of FIG. 20.

DETAILED DESCRIPTION OF THE INVENTION

The gas-discharge display device of the present invention comprises a number of discharge cells containing a discharging gas mixture and electrodes, and is characterized in that each cell has one anode and one cathode. The anodes and cathodes are formed as part of a matrix array of electrodes and displaying and scanning are achieved by changing the effective, display discharging and scanning discharging current, respectively, or by changing the time period of discharging.

The inventors have intensively researched and studied display devices from the standpoint of (1) preventing cross-talk, (2) obtaining a clearer display and (3) constructing the device with as simple construction as possible.

As a result of the researches and studies, the inventors found that with a fundamental construction that is substantially the same as that of Skellet's device, by means of using an improved driving means, a device with a stable and clear display with less cross-talk is obtainable.

Figure 1:
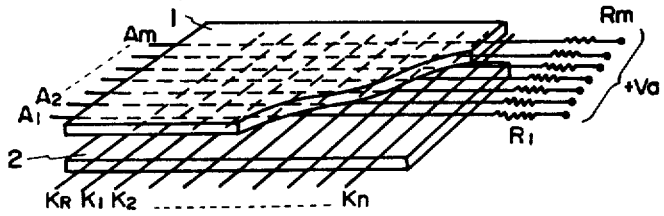
FIG. 1 (Prior Art)
FIG. 1 is a fragmental perspective view of a known gas-discharge device in accordance with the skellet design.
Figure 2:
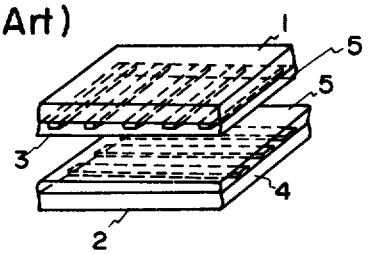
FIG. 2 (Prior Art)
FIG. 2 is a fragmental perspective view of a known gas-discharge device of an Illinois type.
Figure 3:
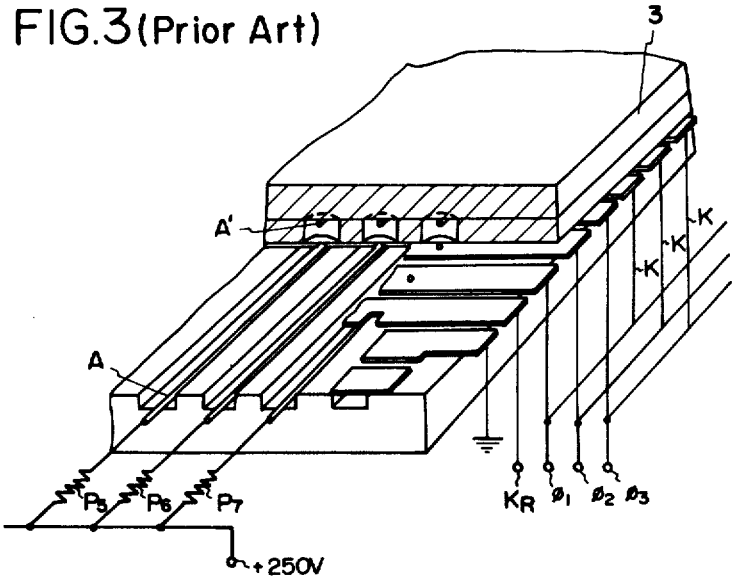
FIG. 3 (Prior Art)
FIG. 3 is a fragmental perspective view of a part of a known gas-discharge device of a Burroughs type.
Figure 4:
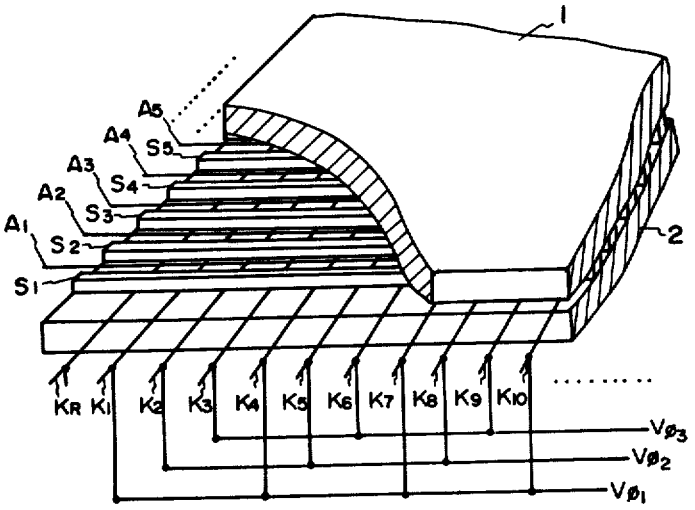
FIG. 4 is a fragmental perspective view of a part of a first example of a gas-discharge device embodying the present invention.

A first example of the present invention is explained referring to FIG. 4. The device of FIG. 4 comprises a pair of parallel glass plates 1 and 2 with a specified gap space therebetween. In the gap space, there are provided a number of parallel wires $K_R$, $K_1$, $K_2$,—, $K_{10}$ as cathodes and a number of parallel wires $A_1$, $A_2$,—as anodes which are spaced from each other with a specified gap and oriented at right angle to the cathodes. Also, the anodes are spatially isolated from each other by means of isolation barriers S1, S2,—which are disposed in gaps between neighboring anodes. The isolation barriers S1, S2,—serve to limit undesirable dispersions of discharge at light dots, and to support the glass plate 1 and 2. In the display part of the example, the pitch between the cathodes and the pitch between the anodes are 1.27 mm, and each gap between an anode and a cathode at their crossing portions is 0.3 mm. A discharge gas of neon containing 0.2% xenon by volume is confined at a pressure of 150 Torr. in the discharging space between the glass plates 1 and 2.

The device of the present invention has no special electrode for scanning of the discharging dot. The scanning is done by first igniting a discharge between a reset cathode $K_R$ which is at one end of the cathode array and anodes $A_i$ (i=1, 2, 3,—). By impressing a specified igniting voltage between the reset cathode $K_R$ and the anodes $A_i$ for a specified time period, a discharge starts at cross portions of $K_R$-$A_i$. Then, by shifting the voltage from the cathode $K_R$ to the cathode $K_1$, the discharging dot shifts from the cross portion of $K_R$-$A_i$ to that of $K_1$-$A_i$. Subsequently, by further shifting the cathode voltage to $K_2$, $K_3$,—, the discharging dots scan along the anodes to the cross portions on $K_2$, $K_3$,—. Such sequential shiftings of the discharging dots depend on the existence of ions of discharge gas excited by repeated discharging in a specified time interval (for example 1/60 second). Accordingly, scanning of dischargings must be made in sequency along the anodes. In this invention, the scanning discharges are made by the same anodes as the displaying discharge.

Figure 5:
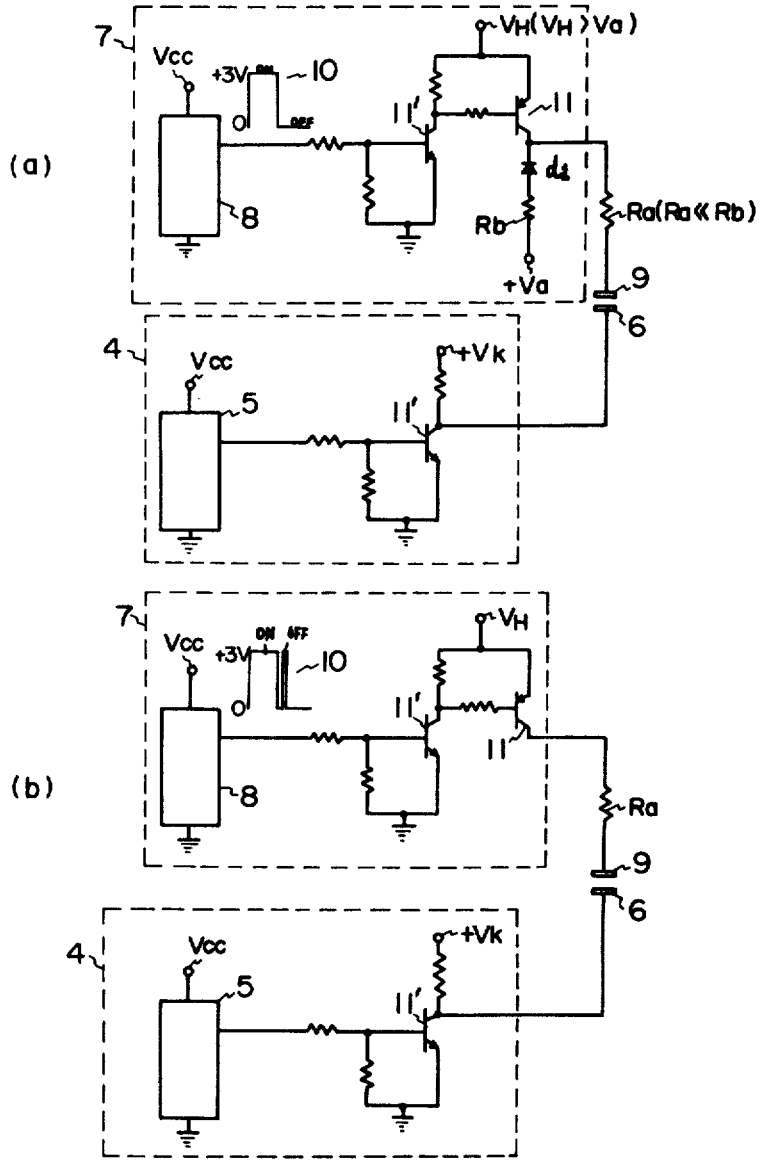
FIG. 5(*a*) and FIG. 5(*b*) are examples of circuit diagrams of driving circuits of the device of the present invention.

FIG. 5(*a*) and FIG. 5(*b*) are two examples of a driving circuit for driving the displaying devices of the present invention.

In the circuit of FIG. 5(*a*), a TTL circuit (transistor-transistor logic circuit) 5 applies a controlling signal to the base of a transistor as a switching device in a cathode driver circuit 4. The cathode driver circuit 4 applies a voltage Vk fed from a terminal +Vk to the cathode 6 of the device when the transistor in the cathode driver circuit 4 is cut off, and applies ground potential when the transistor is turned on. When the voltage Vk is applied to the cathode 6, and at the same time a positive signal 10 (for example 3 V) is applied from a TTL circuit 8 to the base of the transistor 11' of the anode driver circuit 7, thereby making the transistor 11 on, then a discharge current, which is determined by the voltage $V_H$ fed from the terminal $V_H$ and a series of resistor Ra, flows in the anode 9 of the display device. On the other hand, when the output voltage from the TTL circuit 8 is zero, the transistor 11 is off, and the discharge current of the device is determined by the voltage Va fed from a terminal +Va and a resistance of the series connection of a resistor Rb and the resistor Ra. Accordingly, by selecting the resistance of the resistor Rb to be sufficiently greater than that of Ra, the discharging current can be made very small in comparison with the discharge current when the transistor 11 is on. Accordingly, by means of the abovementioned controlling of the discharge current, a smaller current sufficient for operating scanning and a larger current necessary for displaying can be separately obtainable without using a hitherto necessitated special anode for operating the scanning.

In the circuit of FIG. 5(*b*), the terminal +Va, the diode $d_1$ and the resistor Rb of FIG. 5(*a*) are omitted and other parts are similarly constructed to the circuit of FIG. 5(*a*). However, the TTL circuit 8 generates two kinds of signals; namely, wider (longer time period) signals for displaying and narrower (shorter time period) signals for scanning. By means of the substantially changing discharging current, two kinds of discharges, scanning discharge and displaying discharge, are separately obtainable without using the hitherto necessitated special anode for operating the scanning. In a conventional gas-discharge display device of a construction without a special anode for the scanning operation, when a discharge for displaying is not made the ions in the groove along and including an anode extinguish, thereby making scanning impossible. However, according to the present invention, even when there is no displaying, sustaining of ions of the discharge gas in the groove along the anode can be achieved by periodic sequential discharging between the anodes and cathodes with a substantially small current, which does not produce a substantial displaying. In order to clearly distinguish between a displaying and a non-displaying condition, the ratio between the discharging current should be, for example, 20:1 for display discharge compared to non-display discharge current, thereby making the constrast of the light intensity for the non-displaying state to be about (1/20) that of the displaying state. The following Table 1 shows data for one example of the device of FIG. 4.

Table 1

| Data of the first example of FIG. 4. | |
|---|---|
| number of discharging dots | 96 × 36 |
| pitch of the dots | 1.27 mm |
| gap between anode and cathode | 0.3 mm |
| discharge gas | (Ne 99.8% + 0.2% Xe), 150 Torr. |
| display color | orange |
| panel input power | 8W |
| maximum discharge current | 0.6 mA (peak value on light-on state) |
| minimum discharge current | 0.05 mA (peak value on light-off state) |
| ignition voltage between anode and cathode | 250 V |
| discharge sustain voltage between anode and cathode | 150 V |
| duty for scanning | $\frac{1}{100}$ |
| brightness | about 50 fL |

When the circuit of FIG. 5(*a*) is used to control selection between the light-on state i.e., the state for larger effective discharge current, and the light-off state i.e., the state for smaller effective discharge current, in order to increase the contrast between the light-on state and the light-off state, the effective current for the light-off state should be as small as possible. The inventors have found that even for such a small discharge current as less than 0.05 mA, which is likely to make the sustaining of the discharge unstable, the scanning of the glow is stably operated. Moreover, the inventors have also found that in the light-off state, where the discharging is made with a small current, the glow discharge is in the range of normal glow, and the size of glow is restricted in a limited region of the cell or discharge dot. Therefore, contrast between the light-off state and the light-on state is made clear.

When the circuit of FIG. 5(*b*) is used to control selection between the light-on state and the light-off state, in order to increase the contrast between the two states the pulse width of the off-state should be made as narrow as possible to decrease the effective discharge current in that state. But the pulse width should not be smaller than 10μ second, since for a pulse width smaller than 10 μs the effective current becomes too small, thereby making the glow discharging unstable. When the glow scans in the light-off state, the period of repetition of glow scanning should be noted. If the period is longer than 150 μs, the scanning becomes unstable. Especially when the scanning is done in the same manner as that of the Burrough's device discussed below, unstability arises more frequently. In order to eliminate such unstability, it is recommended to increase the number of glow discharging for each cathode by repeating the glow discharge twice in the abovementioned one cycle.

It is considered that scanning discharge and the display discharge are selected by changing the value of integral of the current with respect to time, thereby causing the discharging to be weak or strong.

The driving circuit of FIG. 5(*a*) or FIG. 5(*b*) can be used for the following other example of the present invention.

For use of either the driving circuit of FIG. 5(*a*) or FIG. 5(*b*), the connection of the cathode electrodes can be made, like the Burrough's device, with grouping of the cathodes by commonconnecting them, skipping every three cathodes. Thus the driving circuit can be made simple.

Figure 6:
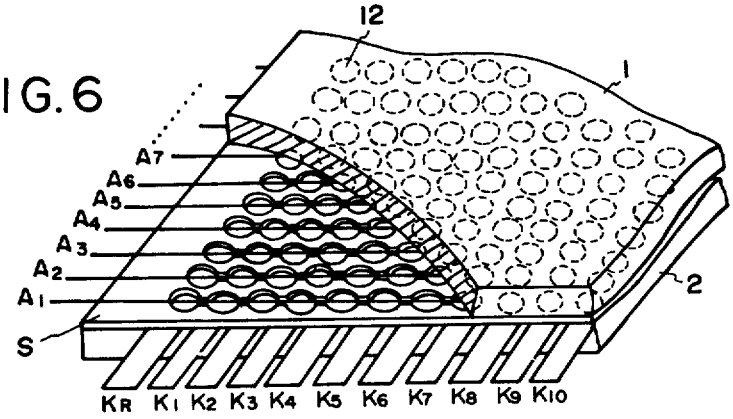
FIG. 6 is a fragmental perspective view of a part of a second example of a gas-discharge device embodying the present invention.

FIG. 6 shows another example of a display device construction, wherein the device comprises an upper glass plate 1 and a lower glass plate 2 holding a dielectric sheet S. The dielectric sheet S has a number of round holes, which are connected to each other with connecting grooves. The holes and grooves form horizontal scanning paths disposed underneath and along the anodes, and each round hole forms a lighting cell having an anode of wire on one end and a cathode of conductor film on the other end. The holes are disposed at cross over points of the anodes $A_1$, $A_2$, $A_3$,—and cathodes $K_R$, $K_1$, $K_2$,—. The upper glass plate 1 has phosphor dots on the lower face thereof, so that the phosphor dots are stimulated to emit fluorescent light upon stimulation by ultraviolet light irradiated by the gas discharging in the cells. For efficient irradiation of the ultraviolet light, the discharging gas confined in the cells is, for example, xenon containing argon and helium as buffer gases. For efficient emission of the fluorescent light, for example for green light emission, known manganese-activated zinc silicate phosphor is used. The configuration of the round hole as the cell serves for efficient confinement of the ultraviolet light within each cell.

Table 2 shows data of the gas discharge display device of FIG. 6.

Table 2

| Data of the second example of FIG. 6 | |
|---|---|
| number of discharging dots | 96 × 36 |
| pitch of the dots | 1.27mm (0.9mm in diameter) |
| gap between anode and cathode | 0.2 mm |
| discharging gas | (Xe-Ar-He), 150 Torr. |
| display color | green emission by $Zn_2SiO_4$ : Mn |
| panel input power | 9.5 W |
| maximum discharge current | 0.8 mA (peak value on light-on state) |
| minimum discharge current | 0.07 mA (peak value on light-off state) |
| ignition voltage between anode and cathode | 300 V |
| discharge sustain voltage between anode and cathode | 220 V |
| duty | $\frac{1}{100}$ |
| brightness | about 30 fL |

The same phenomena explained for the example of FIG. 4 apply to the example of FIG. 6.

Figure 7:
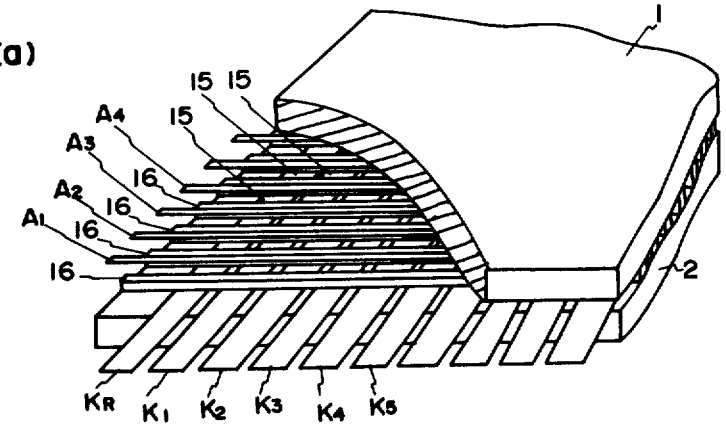
FIG. 7(*a*) is a fragmental perspective view of a part of a third example of a gas-discharge device embodying the present invention.
Figure 7:
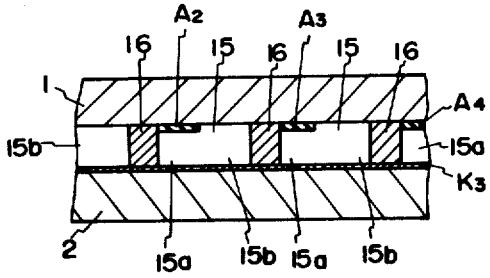

In the devices of FIG. 4 and FIG. 6, the anodes $A_1$, $A_2$, $A_3$,—of thin wires run above the centers of the discharging dots, and therefore, even the dark glows of light-off states are noticeable. FIG. 7 has an improved structure made to overcome the abovementioned problem.

FIG. 7(*a*) is a fragmental perspective view of another example and FIG. 7(*b*) is a sectional view of a part thereof. The device has a pair of parallel glass plates 1 and 2 with a specified gap space therebetween. In the gap space, there are provided a number of parallel stripe shape conductor films $K_R$, $K_1$, $K_2$,—as cathodes and a number of parallel strip shape conductor films $A_1$, $A_2$, $A_3$,—as anodes, in a manner such that the cathodes and the anodes cross over each other at right angles and with a specified gap at each crossing portion. Dielectric barriers 16, 16, 16,—are provided along and between neighboring anodes so that anodes are disposed in a oblong groove 15 defined by the dielectric barriers. The stripe shaped films of anodes are formed to be about 20 μm thick by a paste of synthetic resin containing silver powder as a conductor. The stripe shaped films of cathodes are formed about 20 μm thick by a paste of synthetic resin containing nickel powder as a conductor. Each of the discharge cells in the groove 15 is divided into two parts, namely a first part 15*a* having one of the stripe shaped anodes $A_1$, $A_2$, $A_3$,—and a second part 15*b* which does not have the stripe shaped anodes.

When the effective discharge current is small, namely in the light-off states which are for transferring the glow along the anode in the cell, the glow dischargings take place only in the first part, so that the small glow is covered by the stripe shaped anode. When the effective discharge current is large, namely in the light-on state which is for displaying with a larger glow discharge light, the glow discharging expands to both the first part and the second part, so that the larger glow is clearly noticeable through the upper (i.e., front) glass panel 1.

Figure 8:
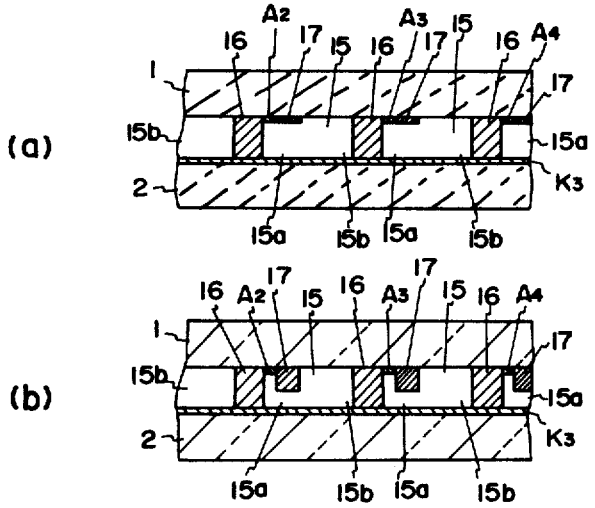
FIG. 8(*a*) is a sectional side view of a part of a fourth example of a gas-discharge device embodying the present invention.

FIG. 8(*a*) and FIG. 8(*b*) show other examples, modified from the construction of FIG. 7. In FIG. 8(*a*), the discharge cell 15 further comprises a stripe shaped opaque, for example black, dielectric film 17 which is disposed between the stripe shaped anodes $A_2$, $A_3$, $A_4$.—and a transparent part on the inner face of the upper glass plate 1. Other parts are constructed similarly with the example of FIG. 7. By means of the opaque dielectric film 17, the small glow light in the light-off state is sufficiently masked, thereby assuring a large contrast of display.

In FIG. 8(*b*), a stripe shaped opaque dielectric film 17 is shaped sufficiently thicker than the anode, so that the light masking effect is better than in the device of FIG. 8(*a*).

As a result of providing the light masking stripe shaped opaque dielectric films 17 near the anode, the light contrast ratio between the light-on and light-off states can be increased from 1.5 to 2 times as high as that of the construction of FIG. 7.

The following Table 3 shows characteristics data for the device of FIG. 8(*a*) and FIG. 8(*b*), when containing a discharge gas of 99.8% Ne+0.2% Xe of 150 Torr. and driven by the driving circuit of FIG. 5(*a*).

Table 3

| Data of the example of FIG. 8(a) and FIG. 8(b) | |
|---|---|
| number of discharging dots | 96 × 36 |
| pitch of the dots | 1.27 mm |
| gap between anode and cathode | 0.3 mm |
| discharge gas | (Ne 99.8% + Xe 0.2%), 150 Torr. |
| display color | orange |
| pannel input power | 8 W |
| maximum discharge currrent | 0.6 mA (peak value on light-on state) |
| minimum discharge current | 0.05 mA (peak value on light-off state) |
| ignition voltage between anode and cathode | 250 V |
| discharge sustain voltage between anode and cathode | 150 V |
| duty | $\frac{1}{100}$ |
| Brightness | 50 fL up |
| contrast ratio | 1 : 30 (FIG. 8(a)) |

Figure 9:
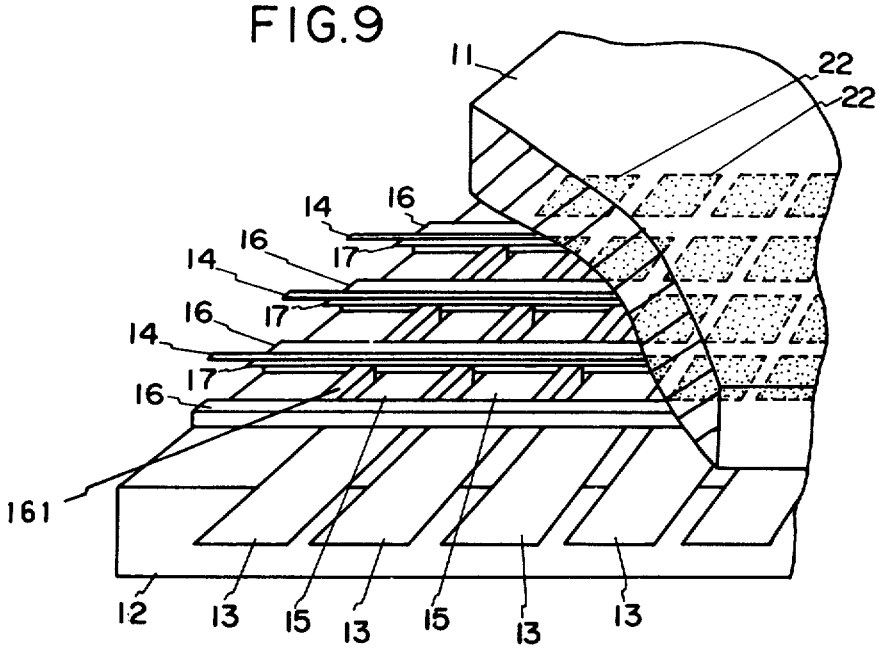
FIG. 9 is a fragmental perspective view of a part of a fifth example.

FIG. 9 shows another example of the device of the present invention, wherein the gas confined in the cell 15 is a mixture of Xe-Ar-He of 150 Torr. so as to irradiate ultraviolet light upon stimulation by impressing a D.C. voltage between the anode and the cathode. An upper glass plate 1 has coatings 22 of phosphors, for example manganese-activated zinc silicate phosphor, for green emission at each discharging dot. The cells 15 are further partly isolated by dielectric barriers 161 from each other. Other parts are constructed similarly to the example of FIG. 8. When a discharging is made by impressing a specified voltage across the anode and the cathode, an ultraviolet light is irradiated, thereby stimulating the phosphor dot to emit visible light. The opaque dielectric film 17 of stripe shape serves to mask the smaller glow light in the light-off states, as well as to reflect the ultraviolet light, thereby improving efficiency.

The following Table 4 shows characteristics data for the device of FIG. 9 when driven by the driving circuit of FIG. 5(*a*). As shown in the Table 4, the device gives a stable and clear display.

Table 4

| Data of the example of FIG. 9 | |
|---|---|
| number of discharge dots | 96 × 36 |

Table 4-continued

| Data of the example of FIG. 9 | |
|---|---|
| pitch of the dots | 1.27 mm |
| gap between anode and cathode | 0.2 mm |
| discharge gas | (Xe 10% + Ar 5% + He 85%), 150 Torr. |
| phosphor | $Zn_2SiO_4$ : Mn |
| display color | green |
| panel input power | 9.5 W |
| maximum discharge current | 0.8 mA (peak value on light-on state) |
| minimum discharge current | 0.07 mA (peak value on light-off state) |
| ignition voltage between anode and cathode | 300 V |
| discharge sustain voltage between anode and cathode | 220 V |
| duty | $\frac{1}{100}$ |
| brightness | 30 fL up |
| contrast ratio | 1 : 30 |

Figure 10:
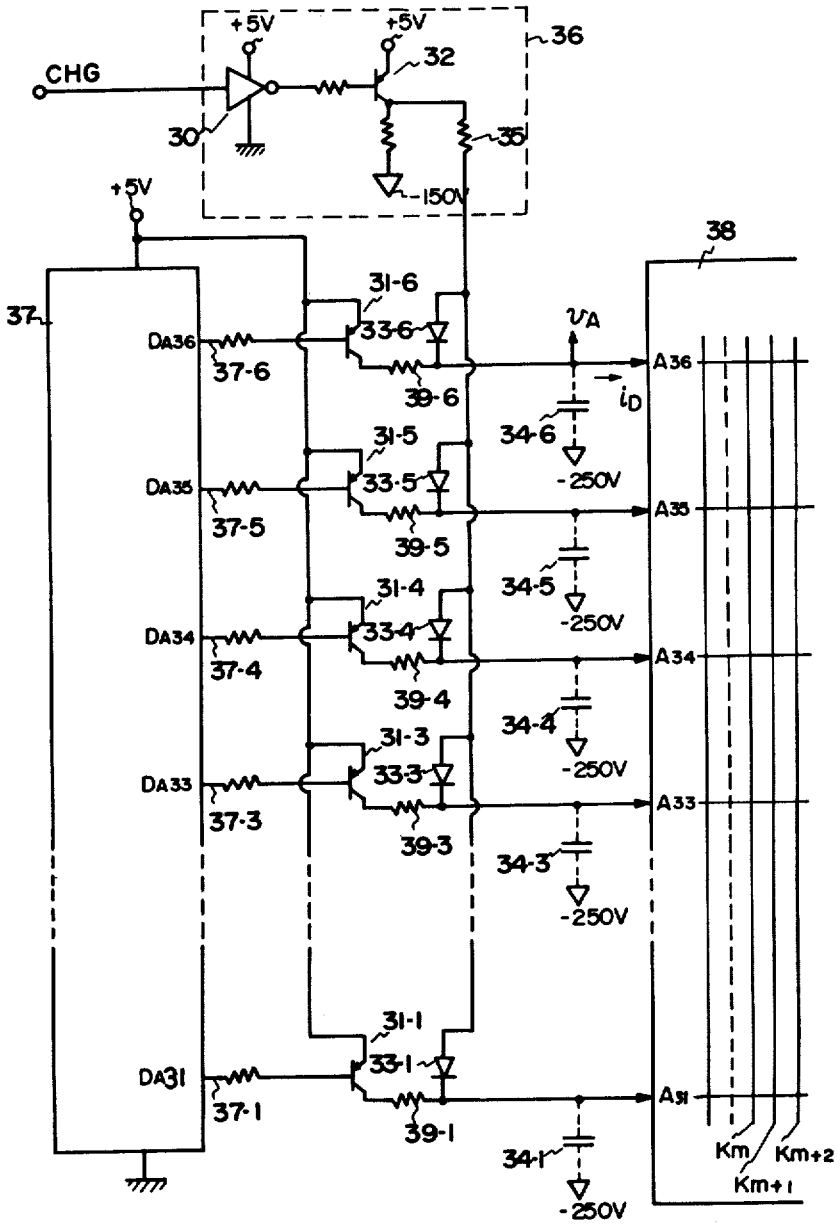
FIG. 10 is a circuit diagram of another driving circuit for the examples of the present invention.
Figure 11:
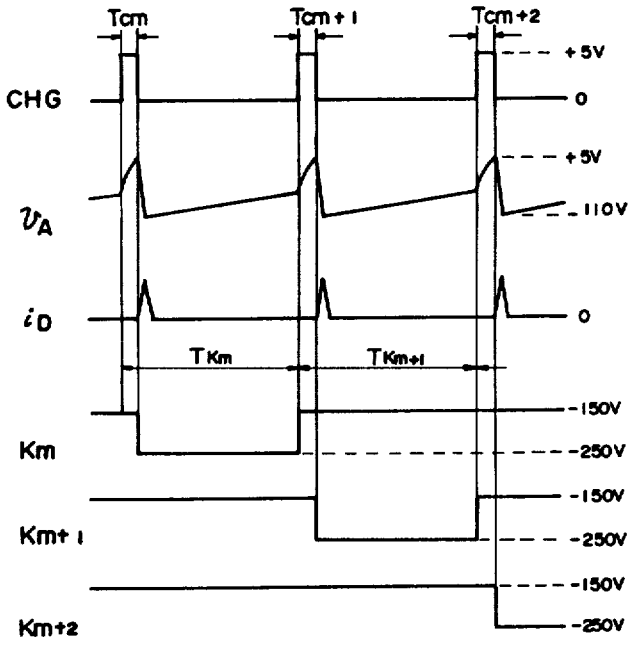
FIG. 11 is a timing chart of waveforms explaining the operation of the driving circuit of FIG. 10.

FIG. 10 shows one example of a driving circuit for the devices of the present invention, which enables a high contrast ratio between the light-on state and the light-off state as well as stable and flicker-free display. FIG. 11 is a timing chart showing waveforms of various parts of the circuit of FIG. 10.

In the circuit of FIG. 10, an anode control circuit 37 furnishes parallel individual signals from the output terminals $D_{A31}$, $D_{A32}$,—, $D_{A36}$ to the bases of the switching transistors 31-1, 31-2,—, 31-6, the collectors of which transistors are connected through the resistors 39-1, 39-2,—, 39-6, to the anodes $A_{31}$, $A_{32}$,—, $A_{36}$ of the display device 38, respectively. To the circuit of the anodes $A_{31}$, $A_{32}$,—, $A_{36}$, capacities 34-1, 34-2,—, 34-6 are connected at their one ends and the other ends thereof are connected in common to a negative terminal −250 V of a D.C. source which feeds a voltage of −250 V. The capacities can be either capacitors of specified capacitance or stray capacities of the anode circuits. A charging signal terminal CHG applies a charging control signal to the control terminal of a TTL inverter 30, which furnishes an output signal to the base of a charging transistor 32. The collector of the charging transistor 32 is connected, through a resistor 35 and through respective diodes 33-1, 33-2,—, 33-6, to the anodes $A_{31}$, $A_{32}$,—, $A_{36}$. Also, the collector of the charging transistor 32 is connected through a resistor to a terminal −150 V which feeds a D.C. voltage of −150 V.

When all of the switching transistors 31-1,—, 31-6 are OFF, thereby making all of the discharging dots in a light-off state, i.e., a glow scanning state, then the signal at the charging signal terminal CHG is made "H" (high level) for a specified short period Tcm at the beginning of each period of impressing −250 V to the cathode, as shown in curve (CHG) of FIG. 11. Therefore, the TTL inverter 30 applies an inverted pulse signal to the transistor 32, thereby making it ON during the "H" of the terminal CHG for the short period Tcm. Accordingly, the capacities 34-1,—, 34-6 are charged by currents flowing for the short time period Tcm through the diodes 33-1,—, 33-6, respectively, thereby raising the potential of the anodes to +5 V, which is fed from a terminal +5 V connected to the emitter of the transistor 32. Incidentally, when the charging signal is "L" (low level), the transistor 32 is made OFF, and therefore, the potential of −150 V is applied to the anodes of the diode 33-1, 33-2,—, 33-6, thereby making these diode OFF.

When the capacities 34-1,—, 34-6 are charged up to +5 V, then a selected cathode is controlled to become −150 V.

Since the capacities 34-1,—, 34-6 are charged to give the potential of +5 V to the anodes, when the voltage of −250 V is applied to one cathode of the display device 38, the voltage between the anode and the cathode of the device 38 becomes 225 V, and hence, discharging takes place. The transistors 31-1,—, 31-6 are made OFF at this time and the transistor 32 is made OFF after the period of Tcm. Therefore, only the charges in the capacities 34-1,—, 34-6 flows into the cell of the discharge device 38. Since amounts of the charges of the capacities are very small, the value of the integral of the discharge current with respect to time is very small. Accordingly, the discharge current ceases in a very short time, and the effective intensity of the glow light is also very weak. Namely, no noticeable displaying is made, but a transfer of glow only is made as shown in the waveform ($i_D$) of FIG. 11. The potential of −250 V is still applied to the selected cathode, and therefore, when the anode potential falls down from the abovementioned +5 V to −110 V, the anode-cathode voltage difference falls to 140 V, and then, the discharging ceases as a result of lowering of the anode-cathode voltage difference. Thereafter, the capacities 34-1,—, 34-6 are again charged by small cut-off currents of the collector of the transistors 31-1,—, 31-6, and the voltages of the capacities slowly rise up. Then, when the charging signal at the terminal CHG comes to the next pulse shown by Tcm+1 of the waveform (CHG) of FIG. 11, the anode potential rises to +5 V. Then, when the potential of −250 V is applied to the next cathode, the voltage between the anode and the cathode becomes 255 V, and another scanning glow discharge takes place between the anode and the cathode. Since the amounts of the charges of the capacities 34-1,—, 34-6 are very small, the value of discharge current integrated with respect to time is very small, and the effective intensity of the glow light is also very weak. Therefore, no noticeable light is produced, but only a transfer of glow (scanning) takes place.

In the similar manner, the scanning i.e., transfers of small glow, are made in sequence along the anode. Since the discharging for scanning is made by charges of the small capacities 34-1,—, 34-6, the effective currents or integral values of current with respect to time are very small for the scanning, and hence, the scanning produces no noticeable light. Since one scanning discharge is necessarily made within each time period $T_{Km}$ of cathode scanning shown in FIG. 11 ($i_D$), the transfer of the glow is very stable and no unpleasant flickering takes place.

Figure 12:
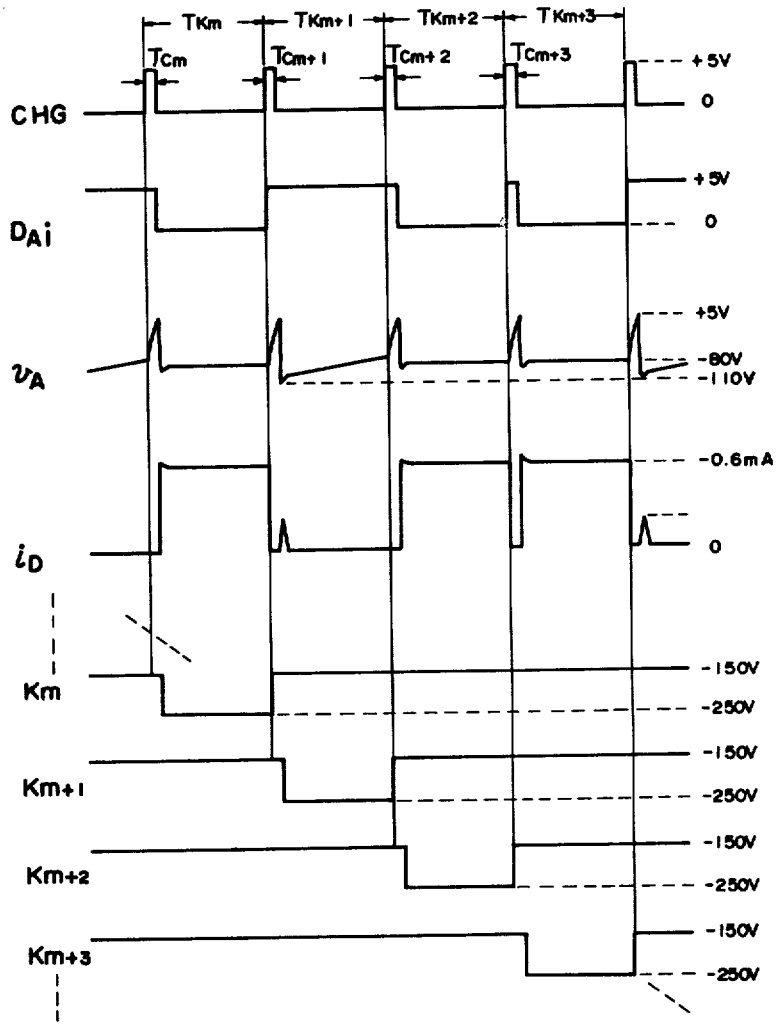
FIG. 12 is a timing chart of waveforms explaining operation of the displaying circuit of FIG. 10.

The operation of the anode control circuit 37 is explained referring to the time chart of FIG. 12. The anode control circuit 37 applies control signals from its output terminals $D_{A31}$, $D_{A32}$,—, $D_{A36}$ to the bases of the anode driving transistors 31-1,—, 31-6, so that light-ons and light-offs at selected parts in the discharge cells along the anode are made by the control signals.

When the charging signals at the terminal CHG is "H" during the charging periods Tcm, Tcm+1, Tcm+2,—, the capacities 34-1,—, 34-6 are changed, as already explained referring to, FIG. 11. Hence, the potentials $V_A$ of all anodes rises to +5 V as shown by the waveform $V_A$ of FIG. 12. Next, as one example, when potentials of the cathodes are scanned from −150 V to −250 V in sequence, one anode, for example $A_1$, has a potential such as shown by the waveform $D_{A31}$ of FIG. 12.

When the anode potential $D_{A31}$ is "L", the anode driving transistor 31-1 becomes on, thereby allowing a large displaying discharge current $i_D$ of 0.6 mA to flow from the left-most +5 V terminal through the emitter and collector of the transistor 33-1 and through the resistor 39-1 to the anode $A_{31}$, thereby producing a bright glow at the discharging dot. Then, the anode voltage $V_A$ is at the discharge sustaining potential of −80 V.

On the other hand, when the anode potential $D_{A31}$ is "H", the anode driving transistor 31-1 becomes off, thereby changing the operation into the scanning described referring to FIG. 11.

In the waveform $i_D$ of FIG. 12, higher and wider pulses show displaying discharges, while lower and narrower pulses show scanning discharges.

As has been described, the device of the present invention enable quick switching of the discharges of all dots between two states of displaying discharge and scanning discharge, responding to the change of the potential of the anodes, by means of changing output signals of the anode control circuit 37.

Figure 13:
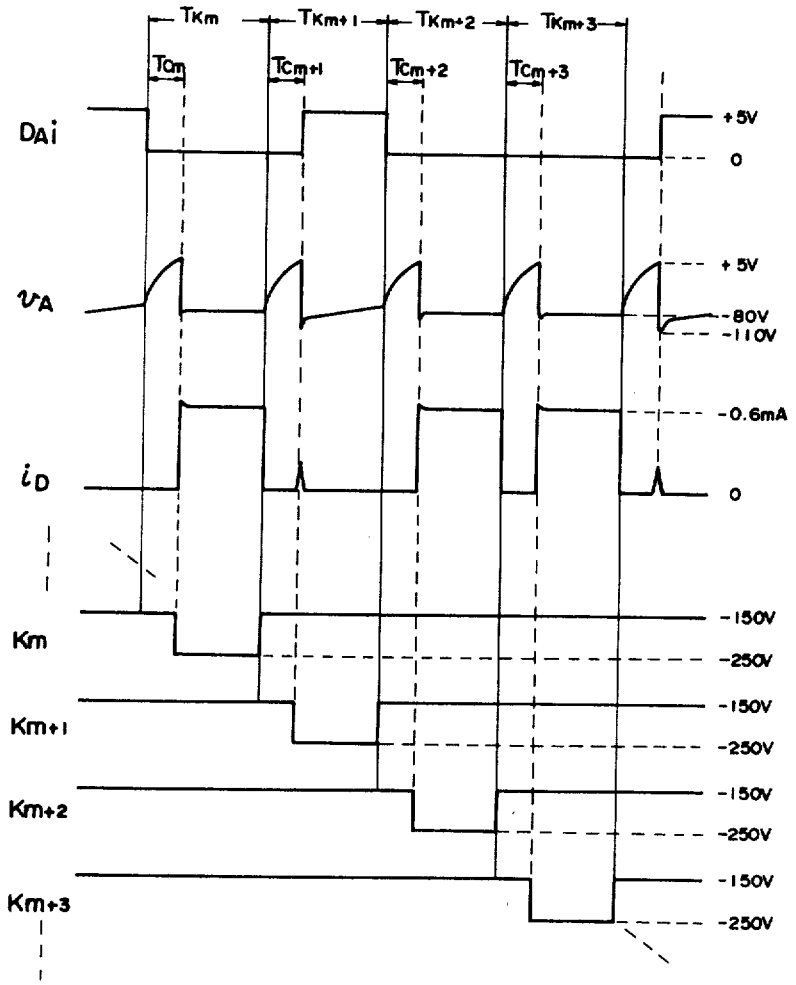
FIG. 13 is a timing chart of waveforms explaining operation of the driving circuit of another example.

FIG. 13 shows operation of a modified example, wherein in the circuit of FIG. 10, all diodes 33-1,—, 33-6 are removed and the capacities 34-1,—, 34-6 are charged through the transistors 31-1,—, 31-6. In FIG. 13, waveforms are shown in similar manners to those of FIG. 12. In the charge up periods Tcm, Tcm+1, Tcm+2,—, the potential of the anode $A_{31}$ becomes "L" as shown by the waveform $D_{A31}$, thereby causing the capacity 31-1 to be charged through the transistor 31-1 and the resistor 39-1. In these charging periods, all cathodes are retained at the potential of −150 V. After completion of the charging, when the anode potential $D_{Ai}$ is "L" the discharge dot undergoes a displaying discharge, while, when the anode potential $D_{Ai}$ is "H" the discharge dot undergoes only a scanning discharge. Thus, a similar operation is obtainable.

In the devices of the abovementioned examples, the fundamental operation of the cathode is to start discharging from the reset cathode $K_R$, impressing the potential of −250 V in sequence, toward the cathodes in the downstream positions, while keeping the cathodes to the potential of −150 V during charging in the capacities of the anodes in order to prevent discharging.

In the abovementioned examples of FIGS. 10 to 13, the scanning discharge currents are decided substantially by stray capacities of the circuit of the anode of the display device and voltage difference between the anode potential before the discharging and the anode potential right after the discharging. Since these stray capacities and potentials are dependent on the construction of the display device and the confined gas, the stray capacities might not be uniform. In such case, in order to make the designing and adjustment of the circuit easy and stable, it is recommended that capacitors of specified capacitance be attached between anodes and the ground line.

Figure 14:
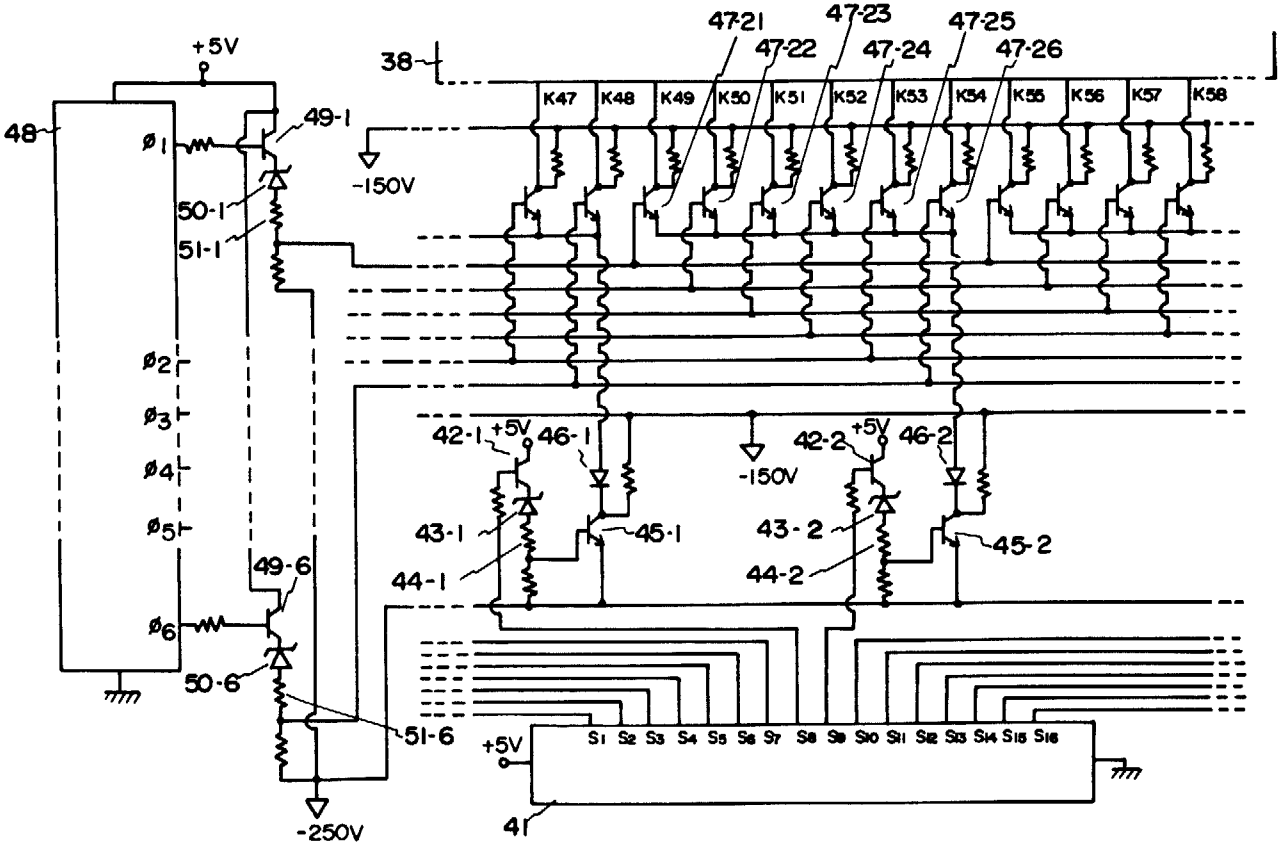
FIG. 14 is a circuit diagram of another driving circuit for examples of the present invention.

One example of a driving circuit for the cathodes, which satisfies the fundamental operation for the abovementioned driving is explained as follows, FIG. 14 shows a part of a driving circuit of a display device, for which some of the cathodes $K_{47}$- $K_{58}$ are shown.

Figure 15:
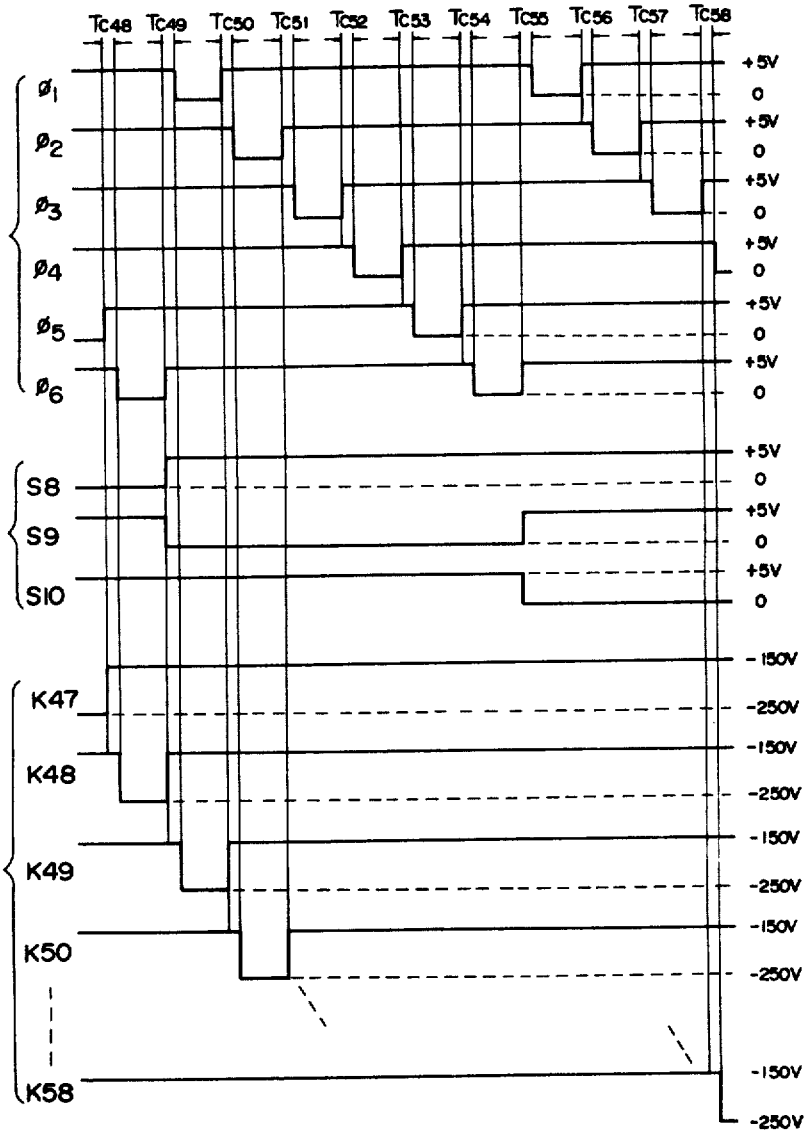
FIG. 15 is a timing chart of the circuit of FIG. 14.

FIG. 15 is a timing diagram. Output signals $S_1$ to $S_{16}$ of a 16- bit shift-register 41 shown in FIG. 14, are useful for this device when they are at low levels. For example, when an output level of $S_9$ is low as shown in FIG. 15, a transistor 42-2 is "on", and base current flows to a transistor 45-2 through a zener diode 43-2 and a resistor 44-2.

To the collector of transistor 45-2 emitters of six transistors 47-21 to 47-26 for cathode switch 21 are commonly connected through a diode 46-2. The reverse voltage of the diode 46-2 is selected to be high so that about 100 V of the reverse voltage is not directly applied between emitters and collectors of transistors 47-21 to 47-26.

On the other hand, 6-phase clock pulses $\phi_1$ to $\phi_6$ from a scanning clock circuit 48 shown in FIG. 14, switches transistors 49-1 to 49-6 "on" when levels of the pulses are low, and a base current flows to transistors 47-21 to 47-26 for the cathode switches through zener diodes 50-1 to 50-6 and resistors 51-1 to 51-6. For example, when the level of the output $S_9$ of the 16-bit shift resister 41 is low, the voltage of the emitters of the transistors 47-21 to 47-26 becomes −250 V. In this case, when the level of the clock pulse $\phi_1$ is also low, base current flows to the transistor 47-21 through the transistor 49-1, the zener diode 50-1 and the resistor 51-1, So that the transistor 47-21 becomes "on" and the voltage at cathode $K_{49}$ becomes −250 V. Then, when the level of the clock pulse $\phi_2$ becomes low without changing the level of the output $S_9$ (i.e. keeping the low level), voltage at a cathode $K_{49}$ also becomes −250 V. In like manner, the voltage at cathodes $K_1$ to $K_{96}$ can be successively changed over between −150 V and −250 V. As shown in FIG. 11, FIG. 12 and FIG. 13, the voltage at the cathodes must be kept at −150 V during the charging period, as required for the cathode operation of the invention.

To fulfill this aim, by delaying each phase of the 6-phase scanning clock pulses $\phi_1$ to $\phi_6$ by their charging time (as shown in FIG. 15), voltages at all the cathodes can be kept at −150 V during the charging period. This situation is illustrated in FIG. 15.

The abovementioned cathode control circuit can be formed by a simple clock circuit and shift register, which are designed by using TTL logic circuits operating at low voltage. By providing as many voltage level converting circuits as number of outputs of the clock circuit and shift register, "on" and "off" operation for the cathodes switching circuit can be made, so the cathode driving circuit is relatively simple.

Figure 16:
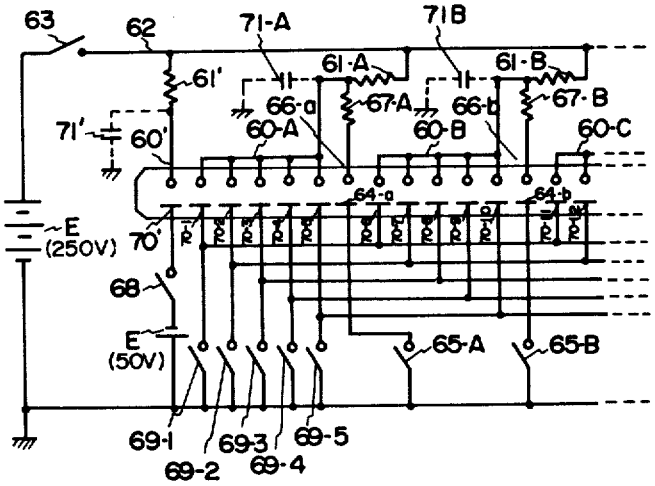
FIG. 16 is a still another driving circuit of the examples of the present invention.
Figure 17:
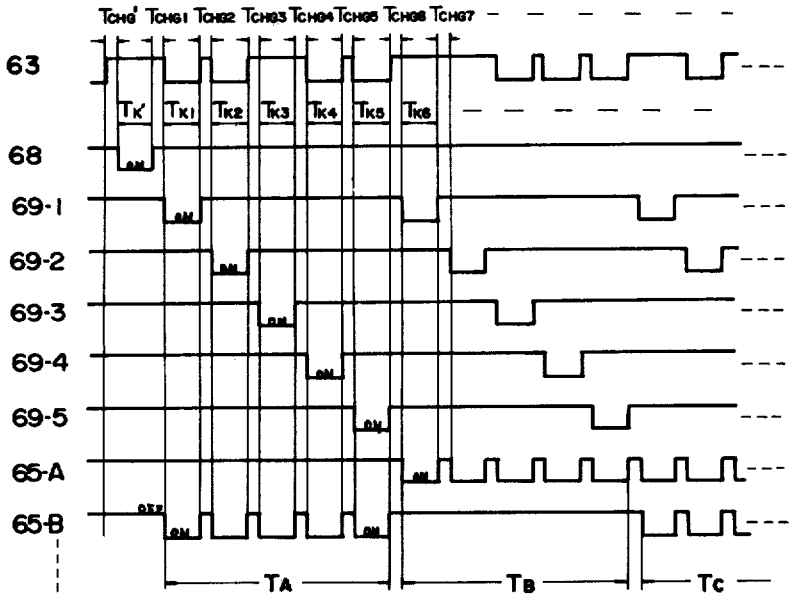
FIG. 17 is a timing chart of the circuit of FIG. 16.

An example of a simplified anode driving circuit, is shown in FIG. 16 and its timing diagram is shown in FIG. 17.

In FIG. 16 an anode 60' for reset, and anode blocks 60-A, 60-B, 60-C, . . . are connected to a lead in wire 62 through resistors 61', 61-A, 61-B, 61-C . . . , respectively, and an anode switch 63 is provided at the lead-in wire.

On the other hand, several cathodes, i.e. scanning electrodes, forming an independent group in one anode block, and are connected with cathodes of corresponding order belonging to other anode blocks. Between the anode blocks are installed control cathodes **64-*a*, 64-*b*, . . . , which are important elements for this embodiment, and control cathode switches (hereinafter control switch for short) 65-A, 65-B, . . . are connected with the control cathodes. Control anodes 66-*a*, 66-*b*, . . . are disposed so as to face the control cathodes 64-*a*, 64-*b*, . . . for setting up control discharge cells. Control anodes 66-*a*, 66-*b*, . . . are connected by a connecting wire to the anode blocks 60-A, 60-B, . . . through resistors 67-A, 67-B**, . . . , respectively.

The timing diagram in FIG. 17 shows a scanning by a resetting cathode switch 68 and scanning switches 69-1 to 69-5. The anode switch 63 is so set in this diagram that the display discharge is obtained on the cathodes 70-3, 70-6, 70-7 and 70-11, and the scanning discharge is observed on other cathodes.

First, the operation during a scanning period $T_A$ for cathodes 70-1 to 70-5 in the anode block 60-A will be explained. Control switch 65-A is kept "off" during the period $T_A$ and accordingly no discharge is generated between the control cathode **64-*a* and the control anode 66-*a*. So, the scanning discharge (when the anode switch 63 is "off") or the display discharge (when the anode switch is "on") is successively scanned between the anode block 60-A and the cathodes 70-1 to 70-5**.

On the other hand, during the time period $T_A$ when the other control switches 65-B, . . . are "off" during several charging times $T_{CHG\,1}$ to $T_{CHG\,5}$ for capacitors 71-B attached to the anode blocks 60-B . . . , and are "on" during several cathode selection times (each step-time period for each cathode in scanning) $T_{K1}$ to $T_{K5}$, control discharge is generated in the control discharge cells between the control cathodes **64-*b*, . . . and control anodes 66-*b***, . . . .

That means voltages of the anode blocks 60-B decrease by this control discharge and no discharge is generated at the cathodes 70-6 to 70-10 facing to the anode block 60-B, and thereby stable scanning takes place in the anode block 60-A. The abovementioned control discharge has nothing to do with display information, and the light therefrom is masked not to emanate outside the display device.

When the discharge cell in the anode block 60-A is under the scanning discharge condition, the anode switch 63 is "off", and the control discharge of other anode blocks 60-B, . . . is done merely with charges in the capacitors 71-B, . . . . Hence, discharge current $i_D$ flows only in a very short time and power consumption is small.

On the contrary, when the anode switch 63 is "on" and the discharge cell near the anode block 60-A is in a display discharge condition for the cathode selection time $T_{K3}$ as shown in FIG. 17, the discharge current flows also into the control discharge cells in other anode blocks 60-B, . . . than the anode block 60-A, through resistors 61-B, . . . . The resistors 67-B, . . . are provided in order to reduce the power consumption in the control discharge cell arising from the control discharge.

After the scanning of the cathodes 70-1 to 70-5 corresponding to the anode block 60-A during $T_A$, the cathodes 70-6 to 70-10 corresponding to the anode block 60-B are scanned during the time period $T_B$. During the period $T_B$, the control switch 65-B is "off", and other control switches (65-A, etc.) are "on" during several cathode selection times $T_{K6}$ to $T_{K10}$ and the control discharge necessarily takes place in the anode blocks other than the anode block 60-B. Accordingly, the voltage in these anode blocks, where the control discharge takes place, decreases, and therefore, a stable scanning is obtained at cathodes 70-6 to 70-10 corresponding to the anode block 60-B. In like manner, the anode blocks are successively scanned.

In order to reduce the power consumption as much as possible, resistors 67-A, 67-B . . . , which are connected with the control anodes 66-*a*, 66-*b*, . . . , should be selected to have large resistances. But there are two problems with the resistors having large resistances. One is that the charging time period for the stray capacities (not shown in FIG. 16), associated with control anodes 66-*a*, 66-*b*, . . . , becomes long, resulting in a short discharge time for the display, thereby making the display dark. The other problem is that the potential at the anode blocks becomes high for the case where the control discharge is made when the anode switch 63 is "on", thereby leading to undesirable discharging at the anode blocks when the potential the discharge-starting voltage. This indicates that the resistance of the resistors 67-A, 67-B, . . . should be preferably as small as possible in order to obtain the precise control discharge operation.

Accordingly, it is necessary to select suitable values for the resistors 67-A, 67-B, . . . taking into account the abovementioned points.

Figure 18:
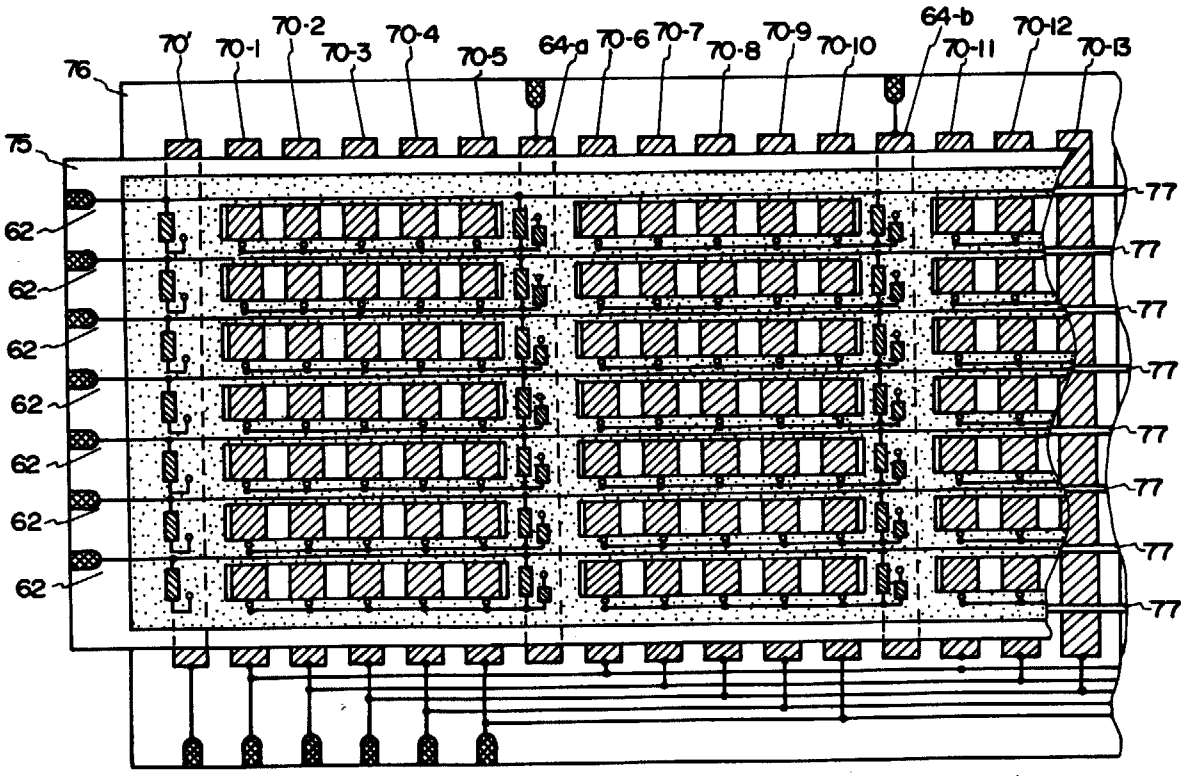
FIG. 18 is a plan view showing an electrode of the example of FIG. 16.

The inner structure of the abovementioned example of the display device will now be explained. The thick-film print technique is used for the device. FIG. 18 shows a display device formed in accordance with the schematic drawing in FIG. 16. A character display of a 5×7 dot matrix is available through seven conductors 62 and five scanning cathodes like 70-1 to 70-5, 70-6 to 70-10, . . . . Control cells, i.e. the control cathodes 64-*a*, 64-*b*, . . . are provided between the cells for character display. A discharge gas mixture (Ne+0.5% Ar) of 150 Torr is filled inside the device.

Characteristics data of the device are given in Table 5. They are obtained when it is operated by the driving sequence shown in FIG. 17.

Table 5

| | |
|---|---|
| number of display characters | 8 |
| colour of display | orange |
| dot pitch | 1.27 mm |
| gap between cathode and anode | 0.3 mm |
| ignition voltage between anode and cathode | 250 V |
| discharge current | 0.6 mA (for display discharge) |
| discharge sustaining voltage | 170 V (for display discharge |
| brightness | 50 fL (for display discharge |
| duty | $\frac{1}{100}$ (for display discharge) |

Figure 19:
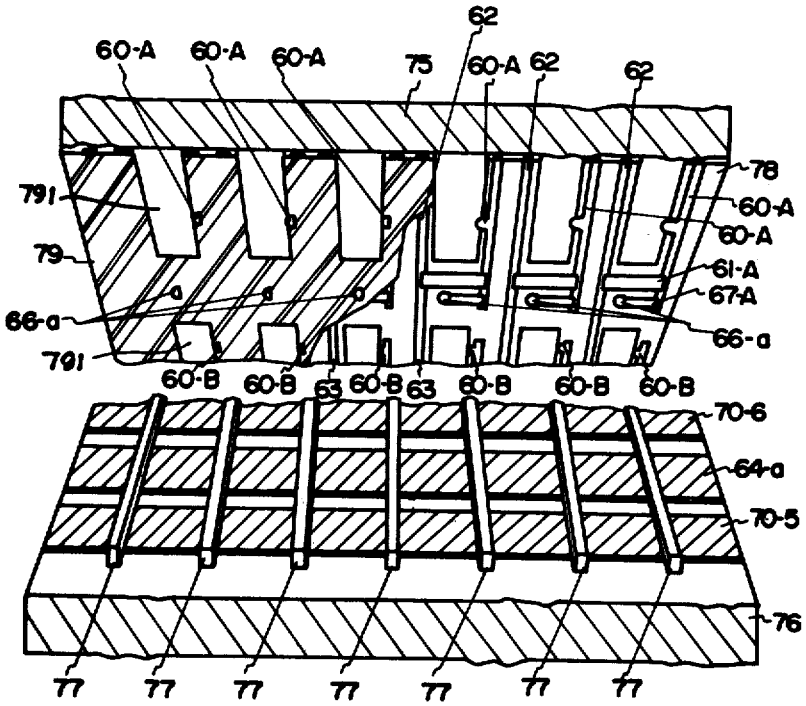
FIG. 19 is a partial developed perspective view of the device of FIG. 18.

FIG. 19 shows a partly developed drawing of FIG. 18. Dielectric paste 78 of a black color is applied on a surface glass plate at portions 75 other than the light-emitting windows 791 to prevent leaking the of light generated by the scanning and control discharge, and further silver paste is applied thereon to form the anode blocks 60-A, 60-B,—, control anodes 66-*a*, 66-*b*,—, and conductors 63. Then resistors 61 and 67 are printed by a resistor paste. Then, dielectric paste 79 is applied to the conductor 63 and resistor paste 61 and 67, exposing only anode blocks 60-A—60-B and control anodes 66-*a* in the discharge space. On a rear glass plate 76 is applied a nickel paste to print cathodes 70-5, 70-6 and 64-*a*, and dielectric paste 77 for cross-talk prevention and for forming discharge spaces is applied thereon. Resistor values are approximately 130 KΩ and 50 KΩ for the dielectric paste 61 and 67, respectively.

In FIG. 18 five cathodes for several anode blocks are successively connected on the rear glass 76, and dielectric paste is applied for isolation between two conductors for lateral and transverse directions.

In the abovementioned example device, the control function for operation of the drive is served by the discharging and the structure of the driving part is simplified while providing a stable display discharge.

Figure 20:
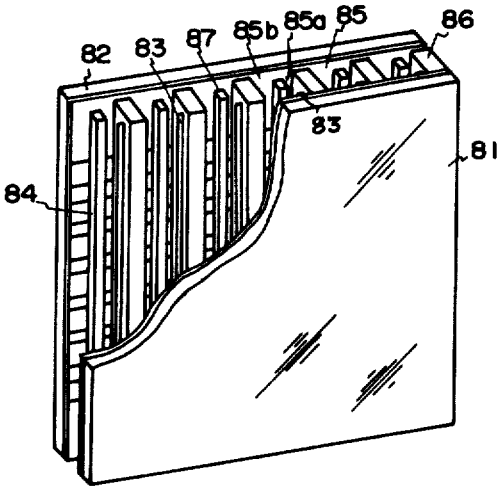
FIG. 20 is a fragmental perspective view of still another device of the present invention.

FIG. 20 shows the fundamental structure of another display device. Anode wire 83 and cathode stripes 84 are disposed crossing one another orthogonally between two glass plates 81 and 82 with a specified gap therebetween. Discharge cell slots 85 are formed at the crossing portions of the conductors by dielectric isolation ribs 86 installed parallel to the anode wires. Further, dielectric barriers 87 are formed parallel to one another on the glass plate of the side of the cathodes in the discharge cell slots 85 in order to divide the discharge space into a scanning region 85*a* and a display region 85*b*. Gases, mainly consisting of an inert gas, are filled in the device to obtain a light emitted by the discharge.

The operational principle for this device is explained in the following. The scanning discharge takes place in the scanning region 85*a* formed in the discharge space of the discharge cell slots 85 shown in FIG. 20. This enables the scanning discharge to be confined in the scanning region 85*a* in the discharge space, thereby keeping the effective value for the discharge current low, i.e. operating the discharge in the normal glow region. It is possible to prevent the leak of the emitted light emanating through the glass plate by making the anode wires 83 opaque or the interface of the glass plate 81 contacting with the anode 83 opaque.

On the other hand, in principle the display discharge provides light emission for display by changing the effective discharge current. When the discharge is obtained with a high effective value of the discharge current, for example, in the abnormal glow region, the discharge spreads to the display region 85*b* in the discharge space inside the discharge cell slot 85 shown in FIG. 20 and the light emission for the display is available from the display region 85*b* through the glass plate 81.

In other words, by forming the dielectric barrier 87 in the unit discharge cell slot 85 on the surface of the cathodes, where a negative glow discharge takes place by one of the anode lines 83, it becomes possible to restrict the spread of the scanning discharge region 85*a*. This results in stable self-scan operation, and any leak of the light to the display region 85*b* is prevented, thereby giving a reliable display for characters and diagrams with high contrast.

Figure 21:
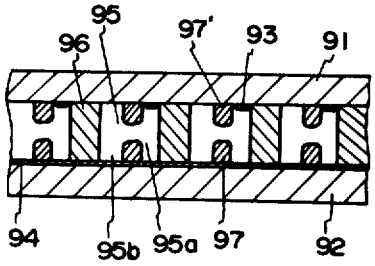
FIG. 21 is a sectional view of a modification of the example of FIG. 20.

FIG. 21 shows an elevation view of a modification of the abovementioned display device. The majority of the structure is the same. The space of the discharge cell 95 is divided by dielectric barrier ribs 96. An additional dielectric barrier 97' is disposed to oppose a dielectric barrier 97, which is similar to the barrier 87 of FIG. 20, and parallel to the anode wires 93. A specified gap is provided between the barriers 97 and 97'.

The dielectric barriers serve to prevent the crosstalk of the light by scanning discharge to display surface. By use of these two opposing dielectric barriers 97' and 97, there is almost no intervention between a scanning region 95*a* and a display region 95*b*. It is possible to obtain quite stable operation characteristics and to greatly improve the contrast of the display by means of the use of both barriers.

Figure 22:
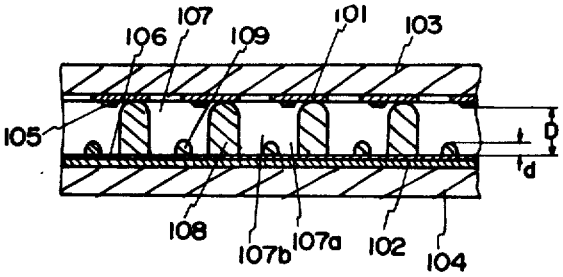
FIG. 22(*a*) is a sectional side view of another modification of the example of FIG. 20.
Figure 22:
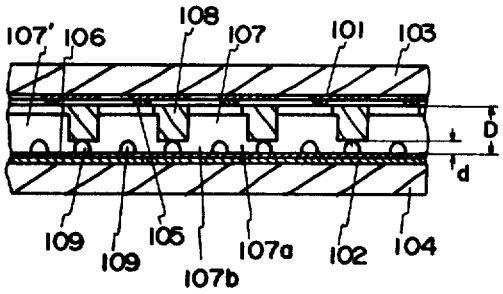

A cross-section view of a typical display device, which is aimed at easy fabrication, is shown FIG. 22(*a*) and FIG. 22(*b*), respectively. Black coating film layers 101 and 102, and a dielectric barrier 109 are formed on glass plates 103 and 104 by applying and baking thick paste film containing a crystalline insulating substance. For anode lines 105 and cathode stripes 106, a paste film containing conductive powder is applied and baked thereon as shown in FIG. 22. The paste materials are successively applied and baked in lamination layers. The two figures are somewhat different in that a dielectric barrier rib 108, which makes discharge cell slots 107, is formed in a slightly different configuration in the two embodiments.

In FIG. 22(*a*) a crystalline insulating thick film paste is applied and baked on the cathode stripes 106 and a quite thick layer results. In FIG. 22(*b*) a thin glass plate the same as glass plates 103 and 104 is etched to form discharge cell slots and discharge cell holes 107', and it is used as an intermediate sheet between the two glass plates 103 and 104.

The following experimental results are obtained for devices of the structure shown in FIG. 22(*a*) and 22(*b*):

(I) In display, no crosstalk discharge of the negative glow extending to neighboring discharge regions could be observed, since the dielectric shield ribs 108 and dielectric barriers 109 are formed on the side of the cathode belts 106.

(II) Since crystalline material is used for the insulating thick paste, it is possible to make fine patterns for the dielectric barrier ribs 108 and barriers 109. The effects of the black coating film layers 101 and 102, the base material for forming the electrodes thereon, is that contrast at a display panel is improved. In addition to this advantage, it is possible to prevent breakage of the glass plates 103 and 104 due to thermal diffusions and diffusion reaction of the conductive material into them during successive thermal treatment processes. Moreover, interface stress could be considerably reduced at the contacting face between glass plates 103 and 104, electrodes 105 and 106, and barrier ribs 108. (Peeling off due to thermal expansion difference is most often observable for electrodes with metal plating).

(III) As suitable distance D between the cathode 106 and anode 105 for the devices in FIG. 22 is;

0.3 to 0.4 mm for 200 Torr. of filled mixed gas (Ne with the addition of a small amount of Ar).

0.2 to 0.3 mm for 150 Torr. of filled mixed gas (Xe with buffer gases, for phosphor excitation).

The height d of the dielectric barrier 109 is selected to be about D/4 for both cases. It was confirmed that almost stable and high-contrast display characteristics was obtainable within about 90° of visual angle at the display surface without providing the dielectric barriers 97' of FIG. 21.

As described above, for the embodiments of the present invention shown in FIG. 21 and FIG. 22, the dielectric barriers and the dielectric isolating wall ribs (structural elements for the discharge cells) are formed closely contacting with the surface of the cathodes, where the negative glow is generated. Both regions (scanning and display discharge regions) and discharge cells are completely divided. Interference between the scanning discharge regions and display discharge regions and crosstalk of discharge between discharge cells are therefore prevented, so that extremely stable driving operation is realizable.

The black coating film layer, and the dielectric barriers and isolating wall ribs are formed by crystalline insulating paste materials, so that forming a fine pattern for their structure is possible. The black coating film layer prevents or reduces the diffusion of the conducting paste material into the glass plate as well as peeling-off of the electrodes due to the difference of expansions between metal and glass.

These embodiments can be produced with high precision their fabrication process is simple, and very thin, mechanical- and heat-resistant devices are available. These fabrication methods for gas discharge display devices are especially effective for high integration of the discharge cells and enlargement of the display screen.

Figure 23:
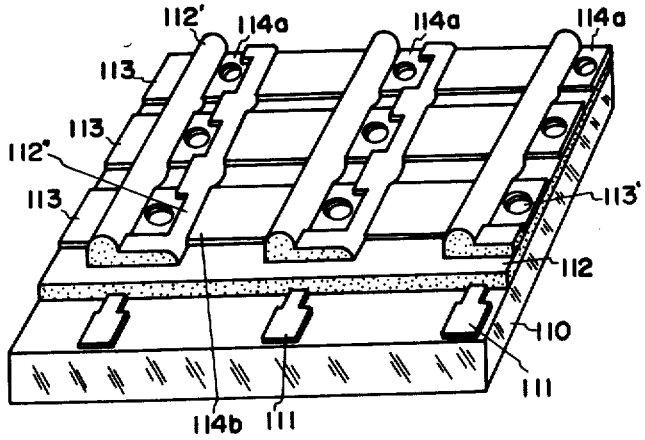
FIG. 23(A) is a perspective view of a part of another example suitable for the present invention.
FIG. 23(B) is a sectional side view of a device made with the construction of FIG. 23(A).
Figure 23:
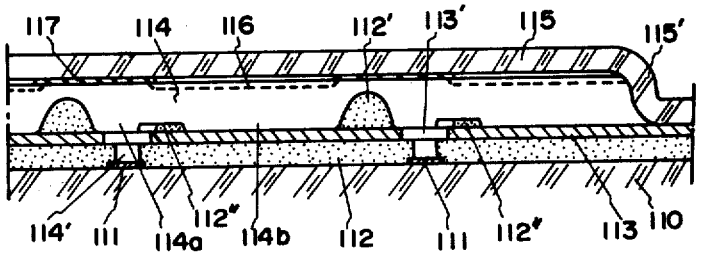

But extremely high integration of the discharge cells and large enlargement of the display screen becomes difficult due to difficulty in alignment of display matrix electrodes. To overcome this shortcoming, a still another display device is provided as shown in FIG. 23.

FIG. 23(A) shows a perspective diagram thereof and FIG. 23(B) shows a sectional side elevational view thereof.

On an inner face of a bottom glass plate 110, anodes 111 are formed as X-axis electrodes (for example, by printing with conductive paste and baking) and a dielectric layer 112 is uniformly printed and baked thereon. Then cathodes 113 are formed as Y-axis electrodes on the dielectric layer 112 (same fabrication procedure as anodes 111). Both anodes and cathodes are electrically isolated except at the cross points of X-Y electrodes, where priming cells 114' are formed corresponding to the positions of priming holes 113' formed in the cathodes 113. These priming cells 114' provide the start of a primary discharge path in this device.

Both dielectric barriers 112' and 112'' formed on the cathodes (Y-axis electrodes), are placed between priming cells 114', parallel to the X-axis electrodes 111. They (112' and 112'') are so disposed by printing with the dielectric paste and baking in a suitable manner, that discharge cells 114 as a display element and both scanning and display discharge regions (**114*a* and 114*b***) are formed.

The height of both dielectric barriers 112' and 112'' can be selected to be relatively low, as long as crosstalk discharge due to negative glow (display discharge) generated at cathodes is prevented between adjoining discharge cells 114 (this case is for the higher dielectric barriers 112') and interference between scanning and display discharge in one unit discharge cell is prevented (this case is applicable for the lower barriers 112'').

A thin display device is obtainable by using a glass plate 115 as a front panel and relatively high light intensity is observed because the display panel and the electrodes are closely situated.

As shown in FIG. 23(B) it is not always necessary to make the higher barriers 112' in close contact with the front glass plate 115, nor to form barriers of uniform height, as long as the front glass is strong enough to resist external pressure during device fabrication and after completion.

Figure 24:
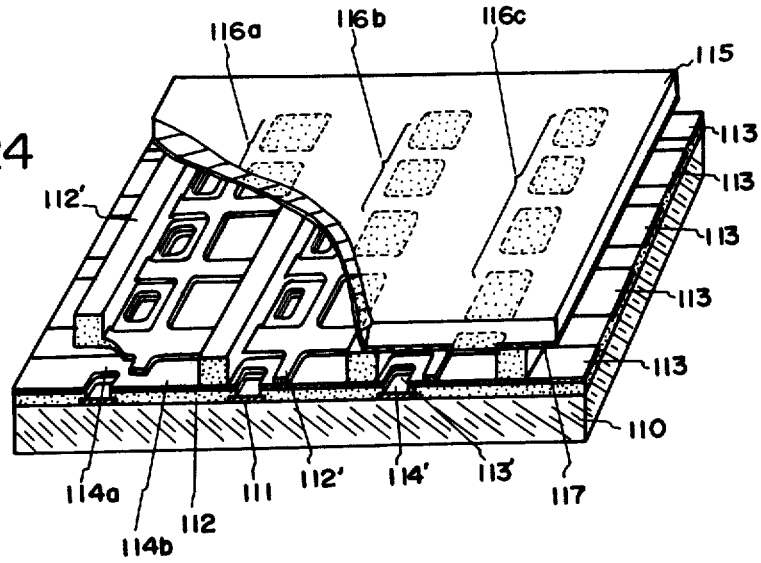
FIG. 24 is a fragmental perspective view of another example of the present invention suitable for color display.

FIG. 24 shows a perspective diagram of a color display device having an effect further developed from the devices of FIG. 23.

Priming holes 113' and priming cells 114' similar to FIGS. 23, (A) and (B) are formed in a rectangular form in a scanning direction of the scanning discharge. Higher dielectric barriers 112' and lower barriers 112'' are made of photosensitive glass or the usual sheet glass by a half-etching process (they can be also formed by dielectric paste like the devices of FIG. 23(A) and (B)).

A front glass plate 115 made of a sheet of flat glass has a close contact with the higher barriers 112' of uniform height. At places facing the cathodes 113 in the display discharge regions 114b, blue, green and red phosphors (116a, 116b and 116c) are coated successively in this order for several unit discharge cells. Three kinds of phosphor materials are applied in dots, and a black coating film layer 117 covers the spaces between dots to improve the display contrast.

In case of the display devices shown in FIG. 23 and FIG. 24, the fabrication process for display electrodes and discharge cells, which requires a fine matrix arrangement for discharge paths, becomes more simple than the conventional fabrication process for gas discharge display devices. The necessary electronics parts are pre-fabricated on the insulating plate glass, and working preciseness is therefore high during the fabrication and assembly process. Moreover, the discharge characteristics for different discharge cells become almost equal and stabilized ones.

The integrated structure of the display matrix electrodes enables the decreasing of gaps between the display panel and the surface of the cathodes. This means that the amount of ultraviolet light stimulating the phosphor dots increases and light intensity from the phosphor dots is remarkably improved. Besides, the form of the display device becomes thin, and mechanically and thermally strong devices are obtainable by utilizing the embodiment of the invention.

What we claim is:

1. A gas discharge display device comprising means defining an enclosed space filled with a discharge gas, a plurality of first electrodes and a plurality of second electrodes disposed within said enclosed space, said first and second electrodes oriented to cross one another at cross points with a predetermined gap therebetween, thereby forming discharge dots at said cross points, dielectric barriers disposed within the enclosed space along at least either of said plurality of first electrodes or said plurality of second electrodes, thereby dividing said enclosed space into rows of discharging cells, each of said discharging cells having a scanning discharge and a display discharge portion, said plurality of first electrodes being adjacent said scanning discharge cell portions and spaced from said display discharge cell portions, a driving circuit connected to said plurality of first electrodes and said plurality of second electrodes for sequentially providing said electrodes with first signals causing strong display discharges, and second signals causing weaker scanning discharges, both said display and scanning discharges occurring between the same pairs of one of said first electrodes and one of said second electrodes, respectively.

2. A gas discharge display device of claim 1, wherein said weaker scanning discharges are made periodically with a predetermined period of repetition.

3. A gas discharge display device of claim 1, wherein said first signals are of larger values of integral of discharge current with respect to time thereby to produce strong discharges resulting in a bright light and said second signals are of smaller values of integral of discharge current with respect to time thereby to produce weak discharges which do not produce any substantial light.

4. A gas discharge display device of claim 1, wherein said first signals are of larger currents and said second signals are of very much smaller currents.

5. A gas discharge display device of claim 1, wherein said first signals cause discharges of a longer time period and said second signals cause discharges of a very much shorter time period.

6. A gas discharge device of claim 1, wherein said first cell portion is the portion masked by the first electrode and said second cell portion is the portion not masked by the first electrode.

7. A gas discharge display device of claim 6, which further comprises a light stopping dielectric body disposed in said first portion.

8. A gas discharge display device of claim 1, which further comprises partial barriers which partly divide each space of said discharging cell.

9. A gas discharge display device of claim 1, wherein said driving circuit comprises:

a circuit which charges into capacities in each of said first electrodes prior to every transferring of discharging from one of said second electrodes to another of said second electrodes, and discharges said capacities to perform said weaker discharges for scanning.

10. A gas discharge display device of claim 9, wherein said capacities are stray capacities of said first electrodes.

11. A gas discharge display device of claim 9, wherein said capacities are a combination of stray capacities and additional capacitors.

12. A gas discharge display device of claim 1, which comprises, on a first insulating plate, an array of said first electrodes, a spacer with through-holes for priming gas discharge and an array of said second electrodes and a second insulating plate, in sequence in said order, said through-holes being disposed on the portions where said first electrodes and said second electrodes cross.

13. A gas discharge display device of claim 1, which comprises:

parallel disposed second electrodes, which are divided into plural groups consisting of a specified number of said second electrodes, said second electrodes being connected in a manner that electrodes of the corresponding order in every group are connected in common, a predetermined number of parallel disposed first electrodes, which are disposed crosswisely of and over said second electrodes of each of said group, each of said first electrodes disposed in the same longitudinal direction being connected through a resistor in common to respective outside connecting terminals, and control discharge cells connected to said first electrodes respectively to lower the potentials of said first electrodes by their discharges.

* * * * *